US009162473B2

(12) United States Patent
Wada et al.

(10) Patent No.: US 9,162,473 B2
(45) Date of Patent: Oct. 20, 2015

(54) PRINTING APPARATUS AND PRINTING METHOD

(71) Applicant: SEIKO EPSON CORPORATION, Tokyo (JP)

(72) Inventors: Hiroshi Wada, Azumino (JP); Toru Takahashi, Azumino (JP); Takamitsu Kondo, Shiojiri (JP); Kazuyoshi Tanase, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/259,956

(22) Filed: Apr. 23, 2014

(65) Prior Publication Data

US 2014/0232775 A1 Aug. 21, 2014

Related U.S. Application Data

(63) Continuation of application No. 13/490,872, filed on Jun. 7, 2012, now Pat. No. 8,740,375.

(30) Foreign Application Priority Data

Jun. 10, 2011 (JP) ..... 2011-130359

(51) Int. Cl.

| | |
|---|---|
| ***B41J 2/01*** | (2006.01) |
| ***B41J 2/21*** | (2006.01) |
| ***B41J 11/00*** | (2006.01) |
| ***B41M 7/00*** | (2006.01) |

(52) U.S. Cl.

CPC *B41J 2/21* (2013.01); *B41J 2/2114* (2013.01); *B41J 11/002* (2013.01); *B41M 7/0081* (2013.01)

(58) Field of Classification Search

CPC ..... B41J 11/0015; B41J 11/002; B41J 2/2114
USPC ..... 347/14, 16, 19, 102; 399/45
See application file for complete search history.

(56) References Cited

U.S. PATENT DOCUMENTS

| | | | | |
|---|---|---|---|---|
| 6,877,850 | B2 | 4/2005 | Ishimoto et al. | |
| 7,261,405 | B2 | 8/2007 | Ohya et al. | |
| 7,527,852 | B2 | 5/2009 | Sigel et al. | |
| 8,506,068 | B2 * | 8/2013 | Mimura | 347/100 |

(Continued)

FOREIGN PATENT DOCUMENTS

| | | |
|---|---|---|
| JP | 2000-158793 A | 6/2000 |
| JP | 2005-231350 A | 2/2005 |

(Continued)

*Primary Examiner* — Stephen Meier
*Assistant Examiner* — Sharon A Polk
(74) *Attorney, Agent, or Firm* — Maschoff Brennan

(57) ABSTRACT

A printing apparatus including a head section which discharges a color ink which is cured due to irradiation of light and a clear ink which is cured due to the irradiation of light, an irradiation section which irradiates the light, and a storage section which stores a relationship between a total amount of color duty which is an amount of the color ink which is discharged per unit region and clear duty which is an amount of the clear ink which is discharged per unit region, and glossiness of an image which is printed using the color ink and the clear ink which have been discharged, wherein, according to the color duty in a certain region in the image, the clear duty in the region is determined based on the relationship so that the glossiness of the image is a predetermined value.

12 Claims, 13 Drawing Sheets

(56) References Cited

U.S. PATENT DOCUMENTS

| | | | | |
|---|---|---|---|---|
| 2005/0156964 | A1* | 7/2005 | Hoshino | 347/9 |
| 2006/0284929 | A1 | 12/2006 | Matsuzawa | |
| 2009/0225143 | A1* | 9/2009 | Fukui | 347/102 |
| 2011/0242556 | A1* | 10/2011 | Jinno et al. | 358/1.9 |
| 2012/0321362 | A1* | 12/2012 | Hirota | 399/341 |
| 2013/0258367 | A1* | 10/2013 | Saito et al. | 358/1.9 |

FOREIGN PATENT DOCUMENTS

| | | | |
|---|---|---|---|
| JP | 2009051095 | A * | 3/2009 |
| WO | 2004/069543 | A1 | 8/2004 |

* cited by examiner

PRINTING APPARATUS AND PRINTING METHOD

This application is a Continuation of U.S. application Ser. No. 13/490,872, filed Jun. 7, 2012, which claims priority to Japanese Patent Application No. 2011-130359 filed Jun. 10, 2011. The foregoing patent applications are incorporated herein by reference.

BACKGROUND

1. Technical Field

The present invention relates to a printing apparatus and a printing method.

2. Related Art

A printing apparatus is known which performs printing of an image by landing liquid droplets (dots) on a medium by discharging a liquid such as ink from a head section. As the printing apparatus, for example, there is an ink jet printer which discharges photocurable ink (for example, UV ink) which is cured by irradiation of light such as ultraviolet (UV) light. Using such an ink jet printer, a method is widely known where the UV ink dots are fixed onto the medium by curing with light being irradiated onto UV ink dots which have been formed on the medium after the UV ink is discharged to the medium from a nozzle (for example, JP-A-2000-158793).

In the method of JP-A-2000-158793, the generation of bleeding which occurs between the UV ink dots due to the curing of the UV ink dots, which have been discharged on the medium, using light and it is easy to form an image with excellent image quality.

However, in an image which is printed using UV ink by an ink jet printer, there is a problem where there are irregularities in glossiness. It is considered that differences in the amount of ink per unit region which is discharged onto the medium (referred to as duty) are a cause whereby irregularities in glossiness are generated. That is, there is a difference in the glossiness between a portion where the gradation value of the printed image is high and a portion where the gradation value of the printed image is low and the difference in the glossiness becomes irregularities. For example, in a case where an image of a face of a person is printed, the glossiness is low in a portion such as the color of skin where the gradation value is low and the amount of ink is small (low duty). On the contrary, the glossiness is high in a portion such as the pupils where the gradation value is high and the amount of ink is large (high duty). As a result, there are irregularities in glossiness in parts of the face and it is difficult to form an image with excellent image quality.

SUMMARY

An advantage of some aspects of the invention is to form an image with excellent image quality where irregularities in glossiness are small when performing printing using UV ink by an ink jet printer.

According to an aspect of the invention, there is provided a printing apparatus including a head section which discharges a color ink which is cured due to irradiation of light and a clear ink which is cured due to the irradiation of light, an irradiation section which irradiates the light, and a storage section which stores a relationship between a total amount of color duty which is an amount of the color ink which is discharged per unit region, clear duty which is an amount of the clear ink which is discharged per unit region, and glossiness of an image which is printed using the color ink and the clear ink which have been discharged, wherein according to the color duty in a certain region in the image, the clear duty in the region is determined based on the relationship so that the glossiness of the image is a predetermined value.

The color duty is the amount of the color ink which is discharged per unit region, and when it is described using eight gradation, is a value which is calculated so that the color duty is 100% when the gradation value of color is 255. The color duty may be calculated from the total value of the gradation value of each color or may be calculated from the gradation value for each color.

For example, in a case where the gradation value of K is 128, the gradation value of C is 64, the gradation value of M is 128, and the gradation value of Y is 64 with regard to a pixel A, the color duty is calculated as (128+64+128+64)/(255+255+255+255)×100=37.6%.

The clear duty is the amount of the clear ink which is discharged per unit region and is a value which is calculated so that the clear duty is 100% when the gradation value of clear is 255.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
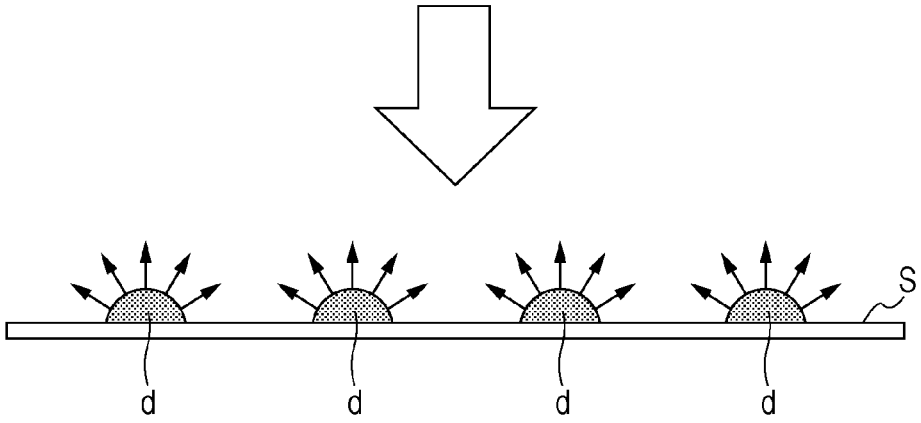
FIGS. 1A and 1B are schematic diagrams with regard to irregularities in glossiness in an image which is printed by an ink jet printer using photocurable ink.

At least the items below will be made clear due to the description of the specifications and the attached diagrams.

There is a printing apparatus including a head section which discharges a color ink which is cured due to the irradiation of light and a clear ink which is cured due to the irradiation of light, an irradiation section which irradiates the light, and a storage section which stores a relationship between a total amount of color duty which is the amount of the color ink which is discharged per unit region and clear duty which is the amount of the clear ink which is discharged per unit region and the glossiness of an image which is printed using the color ink and the clear ink which have been discharged, wherein according to the color duty in a certain region in the image, the clear duty in the region is determined based on the relationship so that the glossiness of the image is a predetermined value.

According to such a printing apparatus, it is possible to form an image with excellent image quality where irregularities in glossiness are small when performing printing using UV ink by an ink jet printer.

In the printing apparatus, it is desirable that the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and that a value based on the first relationship out of a plurality of clear duties be determined as the clear duty which is used when printing in a case where there is a plurality of the clear duties which correspond to a certain size of the color duty based on the first relationship and the second relationship.

According to such a printing apparatus, it is difficult for a difference in the granularity and texture of an image which is printed to stand out and it is possible to print an image with higher image quality.

In the printing apparatus, it is desirable that the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and that a value which is the smallest out of a plurality of clear duties be determined as the clear duty which is used when printing in a case where there is a plurality of the clear duties which correspond to a certain size of the color duty based on the first relationship and the second relationship.

According to such a printing apparatus, it is possible to reduce the printing cost since it is possible to reduce the amount of clear ink which is discharged when printing as much as possible.

In the printing apparatus, it is desirable that the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and that the clear duty which is used when printing be set to zero in a range where there is no clear duty which corresponds to the color duty in a case where the clear duty which is used when printing is determined based on the second relationship.

According to such a printing apparatus, it is possible to reduce the amount of the clear ink which is discharged when printing as much as possible and to print an image where it is difficult for deterioration of an image to stand out.

In the printing apparatus, it is desirable that, with regard to a test pattern with a plurality of types of patches which are formed while changing each of the color duty and the clear duty using the printing apparatus, the relationship is determined by examining the combination of the color duty and the clear duty when the glossiness is a predetermined size based on the glossiness which is measured for each of the plurality of types of patches.

According to such a printing apparatus, the relationship of the total amount of the color ink duty and the clear ink duty with the glossiness is made clear and it is easy to form an image with excellent image quality with few irregularities in the glossiness.

In addition, a printing method is made clear which includes discharging a color ink which is cured due to the irradiation of light and a clear ink which is cured due to the irradiation of light, and irradiating the light, wherein, according to the color duty in a certain region in the image, the clear duty in the region is determined so that the glossiness of the image is a predetermined value based on a relationship between a total amount of color duty which is the amount of the color ink which is discharged per unit region and clear duty which is the amount of the clear ink which is discharged per unit region and the glossiness of an image which is formed using the color ink and the clear ink which have been discharged.

Concept

Image Glossiness

Firstly, the glossiness of an image which has been printed will be described. The glossiness of an image depends on the state of reflected light from a medium with regard to external light. For example, if the reflected light is in a diffuse state, the glossiness is low and there is so-called "matte finish". On the contrary, if close to mirror reflection, high glossiness is obtained and there is so-called "glossy finish". Then, as described above, in an ink jet printer which uses photocurable ink, there are irregularities in glossiness of the printed image. Schematically, the glossiness depends on the amount of ink which is discharged per unit region on the medium, that is, the ejection amount of ink droplets. In the specifications, the amount of ink which is discharged per unit region is also referred to as "ink duty".

Figure 1B:
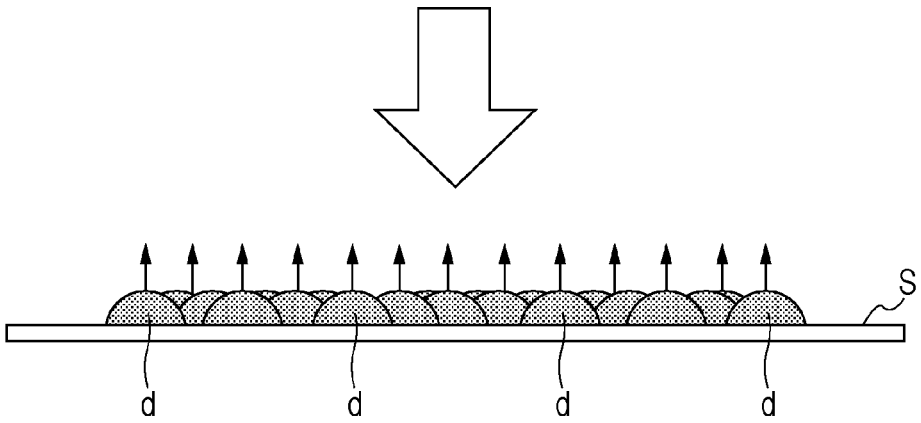

Irregularities in glossiness in an image which is printed by an ink jet printer using photocurable ink are schematically shown in FIGS. 1A and 1B. For example, in a case where the face of a person is printed as an image, parts such as a cheek are a pale skin color. Then, the ejection amount of the droplets (ink droplets) d of ink is small in the printing region of a pale color. Then, as shown in FIG. 1A, since each ink droplet d is cured using light such as ultraviolet light (UV), each ink droplet d on a medium S does not bleed and are independent island shapes with a shape which resembles a semicircle. That is, the density of the ink droplets d is "sparse". As a result, the light which is incident on the surface of the medium S (arrow filled in with white in the diagram) is reflected in various directions by the surface of the ink droplets d with island shapes (solid-line arrows in the diagram). That is, there is diffuse reflection.

On the other hand, as shown in FIG. 1B, a deep color portion such as a pupil is expressed using the solid covering of the image region. That is, the ink droplets d which are adjacent to each other are densely arranged in the image region and ink in a film state is in the same state as if the ink in a film state covers the medium S even if each of the ink droplets d is in a semicircle state. As a result, the incident light is substantially mirror reflected by the surface of the ink in a film state and the glossiness is high. Accordingly, in the face of a person, there is a matte finish in the portions of skin such as a cheek and there is a gloss finish in the portions of the pupil, there is no uniformity in the glossiness, and there is an unnatural image.

Figure 2:
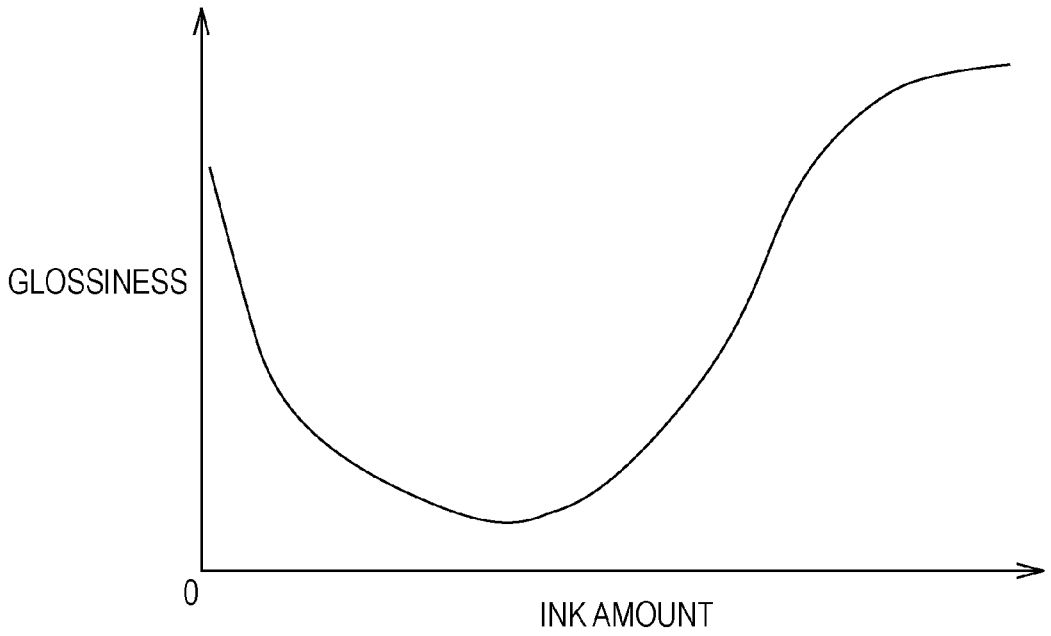
FIG. 2 is a diagram representing a relationship between density of ink and glossiness on a medium.

Above is an outline of the cause of the occurrence of irregularities in glossiness. However, the occurrence mechanism of the irregularities in glossiness which is schematically shown in FIGS. 1A and 1B is a model which has been simplified to a certain extent and the irregularities in glossiness do not simply depend only on the density of the ink droplets d in practice. A relationship between the density of the ink on the medium S and the glossiness is shown in FIG. 2. In the diagram, a relationship is shown between the ink amount (volume) per unit area of the medium S and the glossiness which is measured using a known glossimeter (gloss checker). In a case where the ink amount is extremely low, the glossiness of the medium S is manifested, and when the ink amount increases, diffuse reflection component increases due to the ink droplets d which are sparsely arranged, and the glossiness is reduced. When the ink amount per unit area exceeds a predetermined amount, the mirror reflection component relatively increases and there is a shift so that glossiness increases. In addition, since the glossiness differs according to the type of the medium S itself, in an application where the different types of the medium S are differentiated, the relationship of the ink amount and the glossiness is further complicated.

Concept of Embodiment

As described above, in the printer which uses photocurable ink, the irregularities in glossiness occur due to the density of the ink droplets on the medium. Furthermore, since there is no simple proportional relationship between the density of the ink droplets and the glossiness, it is not possible to resolve the irregularities in glossiness on the same medium using only a uniform change in the glossiness over the entire image even using a medium which has been surface treated such as glossy paper or matte paper. An improvement in the ink has been considered, but it is necessary to optimize the properties in relation to the glossiness of the ink itself without any loss of the original characteristics of photocurable ink where suppression of bleeding is possible. Furthermore, it is necessary to optimize the discharge method of the ink and the like to be appropriate to the properties. As a result, the research and development into periphery technologies such as discharge control and the ink itself take a large amount of time and cost.

Therefore, in the embodiment, a printed image is formed using an ink which prints an image (set as color ink) and an ink which adjusts the glossiness of the image (set as clear ink) and the generation of the irregularities in glossiness is suppressed. Specifically, the amount of glossiness in a predetermined region of the image which is formed on a medium is adjustment by appropriately changing the clear ink discharge amount (clear ink duty) according to the color ink discharge amount (color ink duty) when the image is printed. The details of the discharge amount of each ink and an image processing method when actually performing printing will be described later.

Basic Configuration of Printing Apparatus

A line printer (printer 1) will be described as an example as an embodiment of a printing apparatus which is used in the present embodiment.

Configuration of Printer 1

The printer 1 is a printing apparatus which records an image by discharging a liquid such as ink toward a medium such as paper, cloth, or a film sheet. The printer 1 is a printer using an ink jet method, but the printer using the ink jet method may be an apparatus which adopts any discharging method if it is a printing apparatus where printing is possible by discharging ink.

In the printer 1, an image is printed onto a medium by the discharging of ink which is cured by the irradiation of light such as ultraviolet rays (below, UV), for example, ultraviolet ray curable ink (below, UV ink). The UV ink is ink which includes resin which is cured by ultraviolet rays and is cured by a photopolymerization reaction occurring in the resin which is cured by ultraviolet rays when UV irradiation is applied. In the printing using the UV ink, it is easy to control the degree of curing of the ink dots which are formed on the medium and the shape of the ink dots by controlling the UV irradiation amount and the irradiation timing. Accordingly, as described above, it is possible to form an image with excellent image quality by suppressing the generation of bleeding which occurs among the UV ink dots. In addition, it is possible to perform printing with regard to a medium with no ink absorbency which has no ink acceptance layer by the forming of dots due to the curing of the UV ink.

Here, the recording of an image is performed using color ink of the four colors of black (K), cyan (C), magenta (M), and yellow (Y) as the UV ink and clear ink (CL) which is colorless and transparent in the printer 1 of the embodiment.

Figure 3:
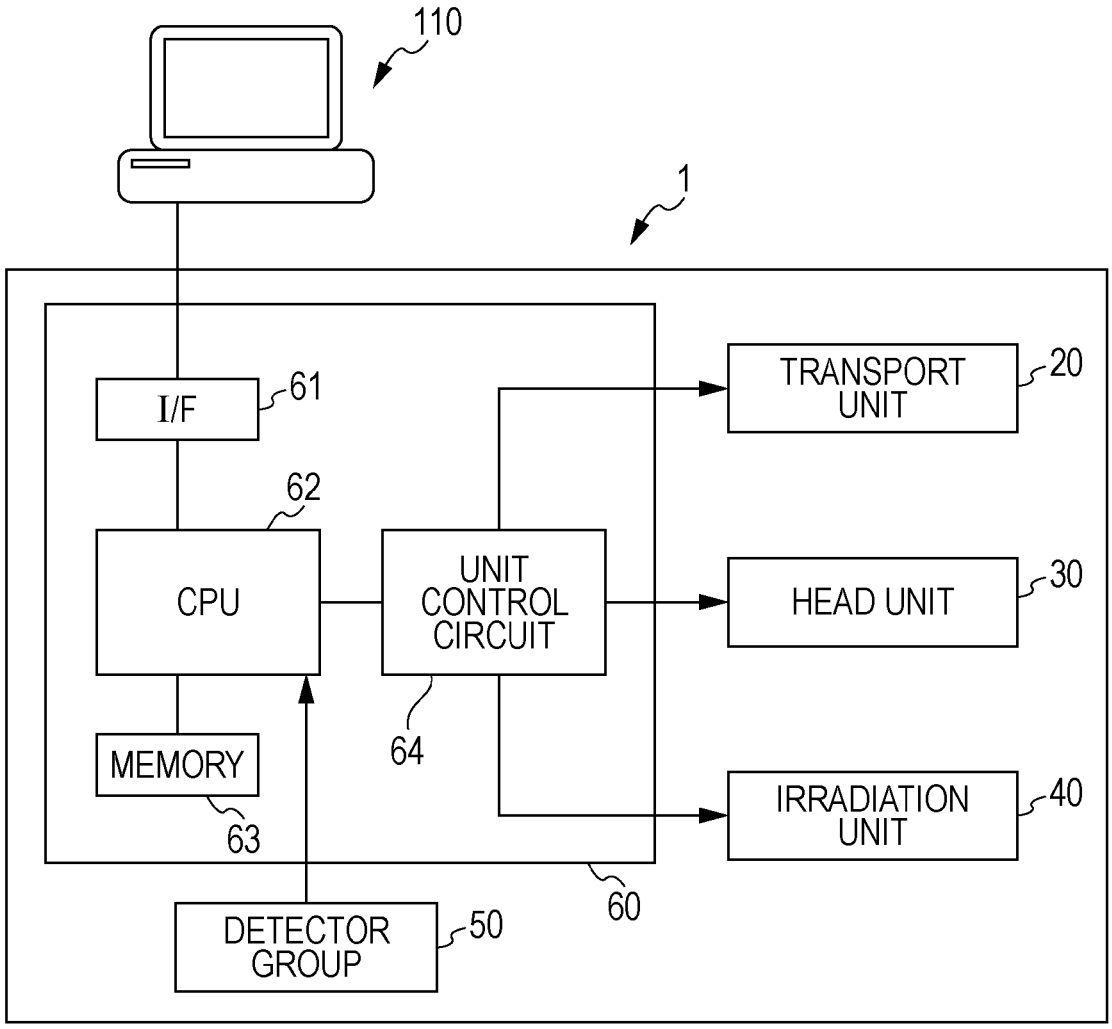
FIG. 3 is a block diagram illustrating the overall configuration of a printer.

FIG. 3 is a block diagram illustrating the overall configuration of a printer 1. The printer 1 has a transport unit 20, a head unit 30, an irradiation unit 40, a detector group 50, and a controller 60. The controller 60 is a control section which controls each of the units such as the head unit 30 and the irradiation unit 40 based on printing data which is received from a computer 110 which is an external device. The circumstances in the printer 1 are monitored using the detector group 50 and the detector group 50 outputs the detection result to the controller 60. The controller 60 controls each of the units based on the detection result which is output from the detector group 50.

Computer 110

The printer 1 is connected so as to be able to communicate with the computer 110 which is an external device. A printer driver is installed in the computer 110. The printer driver is a program which is for displaying a user interface on a display device and for converting image data which is output from the application program into printing data. The printer driver is recorded in a recording medium (a recording medium which is able to be read by a computer) such as a flexible disc FD or a CD-ROM. In addition, the printer driver is able to be downloaded to the computer 110 via the Internet. Here, the program is configured from code for realizing each type of function.

The computer 110 outputs the printing data to the printer 1 according to the image which is to be printed in order for the printer 1 to print the image. The printing data is data with a format which is able to be interpreted by the printer 1 and has various types of command data and pixel data. The command data is data for instructing the execution of specific operations to the printer 1. As the command data, there is, for example, command data which instructs the supply of the medium, command data which indicates the medium transport amount, and command data which instructs the medium discharge. In addition, the pixel data is data which is related to the pixels of the image which is to be printed.

Here, a pixel is a unit element which configures the image and the image is configured by the lining up of pixels in a two dimensional manner. The pixel data in the printing data is data (for example, gradation values) which relates to the dots which are formed on the medium (for example, paper S or the like). The pixel data is configured by, for example, data of two bits for each pixel. The pixel data of two bits is data which is able to express one pixel as four gradations.

Transport Unit 20

Figure 4:
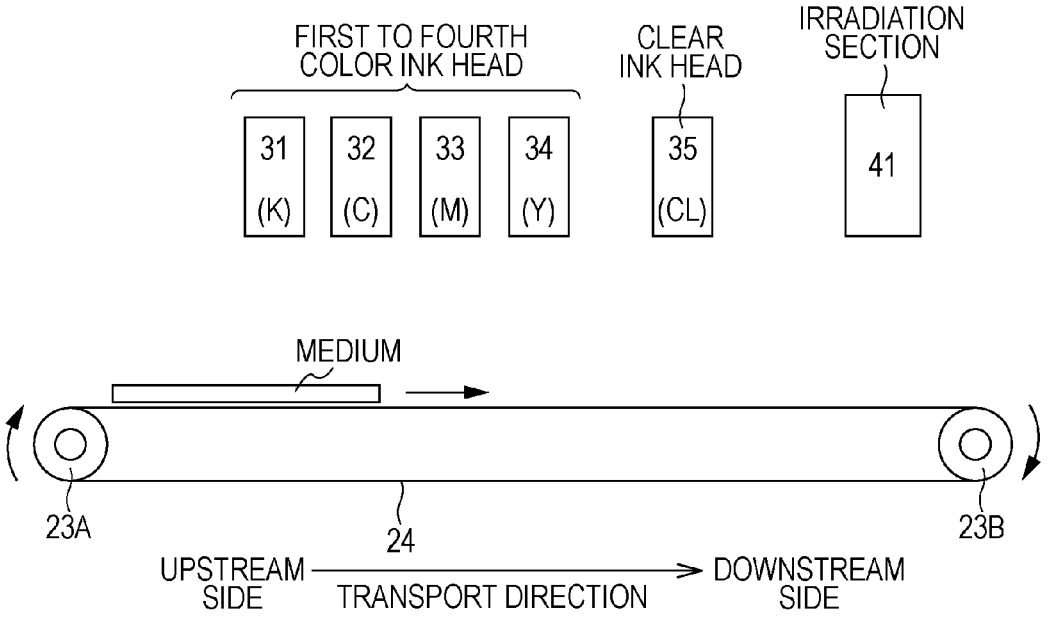
FIG. 4 is an outline side view representing the configuration of a printer.

An outline side view representing the configuration of the printer 1 of the embodiment is shown in FIG. 4.

The transport unit 20 is for transporting the medium in a predetermined direction (referred to below as the transport direction). The transport unit 20 has a transport roller 23A on an upstream side in the transport direction, a transport roller 23B on a downstream side in the transport direction, and a belt 24 (FIG. 4). When a transport motor which is not shown is rotated, the transport roller 23A on the upstream side and the transport roller 23B on the downstream side rotate and the belt 24 is rotated. The medium which is fed using medium feeding rollers (not shown) is transported to a region where printing is possible (a region which opposes the head unit 30 and the like which will be described later) by the belt 24. The medium which passed through the region where printing is possible is discharged to the outside by the belt 24. Here, the medium during transportation is electrostatically adsorbed or vacuum adsorbed to the belt 24.

Head Unit 30

The head unit 30 is for discharging the UV ink to the medium. The head unit 30 forms ink dots by discharging each color ink of the color (KCMY) and clear (CL) with regard to the medium during transportation and prints the image on the medium. The printer 1 of the embodiment is a line printer and each head of the head unit 30 is able to form a plurality of dots to the extent of the width of the medium at one time.

The color ink heads 31 to 34 are provided in the printer 1 as shown in FIG. 4 in order from the upstream side in the transport direction. The color ink heads are configured from a first color ink head 31 (referred to below as the first head 31), a second color ink head 32 (referred to below as the second head 32), a third color ink head 33 (referred to below as the third head 33), and a fourth color ink head 34 (referred to below as the fourth head 34). In the embodiment, black ink (K) is discharged from the first head 31, cyan ink (C) is discharged from the second head 32, magenta ink (M) is discharged from the third head 33, and yellow ink (Y) is discharged from the fourth head 34. However, which of each of the color inks are discharged from the color ink heads 31 to 34 is arbitrary, and for example, yellow ink (Y) may be discharged from the first head 31 and black ink (K) may be discharged from the second head 32. In addition, other than the color ink heads 31 to 34, a color ink head which discharges an ink with a color other than KCMY described above (for example, light cyan, a metallic color, or the like) may be provided. In addition, the first head 31 and the second head 32 may discharge ink of the same color. For example, both the first head 31 and the second head 32 may discharge cyan ink (C).

The clear ink head 35 which discharges clear UV ink (CL) which is colorless and transparent is provided in the downstream side of the color ink head 34 in the transport direction. Here, the clear ink (CL) is an ink which is typically referred to as "clear ink" with no or a small amount of colorant being included. Below, the clear ink head 35 is referred to as the fifth head 35.

Each of the heads are each configured from a plurality of heads with short lengths and each of the heads with short lengths are provided with a plurality of nozzles which are discharge outlets for discharging the UV ink.

Figure 5A:
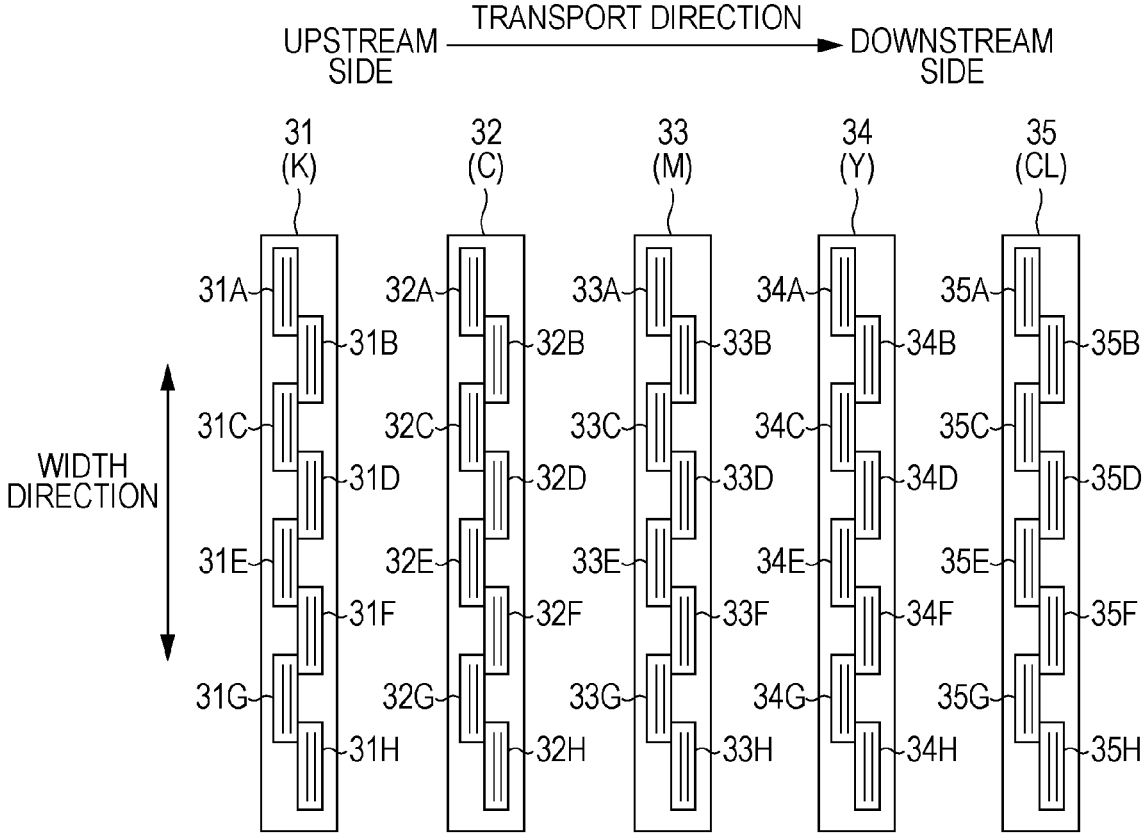
FIG. 5A is a diagram describing an arrangement of a plurality of heads with short lengths in color ink heads and a clear ink head in a head unit.
Figure 5B:
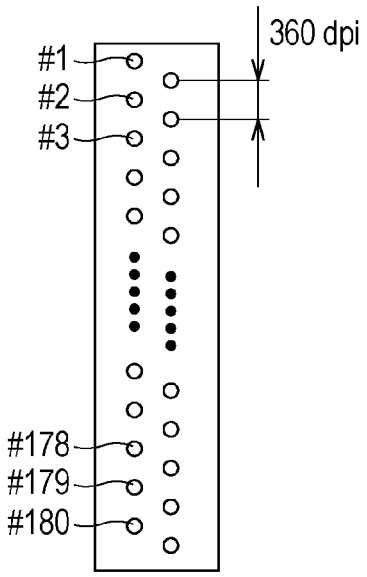
FIG. 5B is a diagram describing an appearance of a nozzle row which is arranged at a lower surface of each head.

FIG. 5A is a diagram describing the arrangement of a plurality of heads with short lengths in the color ink heads 31 to 34 and the clear ink head 35 of the head unit 30. FIG. 5B is a diagram describing an appearance of nozzle rows which are respectively arranged on a lower surface of each of the heads with short lengths. Here, FIG. 5A and FIG. 5B are diagrams where the nozzles are virtually viewed from an upper surface.

In the first head 31, eight heads 31A to 31H with short lengths are each lined up with a zigzag arrangement shape along the width direction of the medium which is a direction which intersects with the transport direction of the medium. In the same manner, eight heads 32A to 32H with short lengths are lined up in a zigzag arrangement shape along the width direction also in the second head 32. The third head 33, the fourth head 34, and the fifth head 35 are the same (FIG. 5A). In the example of FIG. 5A, each of the heads is configured from eight heads with short lengths, but the number of heads with short lengths which configure each of the heads may be more than eight or may be less than eight.

A plurality of nozzles rows is formed for each of the heads with short lengths (FIG. 5B). The nozzle rows are each provided with 180 nozzles which discharge ink and the nozzles are lined up with a constant nozzle pitch (for example, 360 dpi) from #1 to #180 along the width direction of the medium. In a case of FIG. 5B, two rows of nozzle rows are lined up in parallel and the nozzles of each of the nozzle rows are provided in positions which are each shifted by 720 dpi in the width direction of the medium. Here, the number of nozzles in one row is not limited to 180. For example, 360 nozzles may be provided in one row or 90 nozzles may be provided. In addition, the number of nozzle rows which are provided in each of the heads with short lengths is not limited to two rows.

In each of the nozzles, a piezoelectric element which is an ink chamber and a piezo element (neither of which are not shown) is provided. The piezo element is driven by a driving signal COM which is generated by a unit control circuit 64. Then, ink which has filled the ink chamber is discharged from the nozzle by the ink chamber being companded or expanded due to the driving of the piezo element.

It is possible for ink droplets with a plurality of types with different sizes (with different ink amounts) to be discharged from each nozzle using the size of a pulse which is applied to the piezo element according to the driving signal COM. For example, it is possible for three types of ink, which are configured from a large ink droplet with an amount which is able to form a large dot, a medium ink droplet with an amount which is able to form a medium dot, and a small ink droplet with an amount which is able to form a small dot, to be discharged from each of the nozzles. Then, each of the nozzles forms a dot line (raster line) along the transport direction of the medium by the discharging of the ink droplets intermittently from each of the nozzles with regard to the medium during transportation.

Irradiation Unit 40

The irradiation unit 40 is for irradiating UV toward the UV ink dots which have landed on the medium. The dots which have been formed on the medium are cured by receiving UV irradiation from the irradiation unit 40. The irradiation unit 40 of the embodiment is provided with an irradiation section 41.

The irradiation section 41 is provided on the downstream side of the clear ink head 35 in the transport direction (FIG. 4) and the UV ink dots which are formed on the medium using the color ink heads 31 to 34 and the clear ink head 35 are irradiated with UV for curing. The length of the width direction of the medium of the irradiation section 41 is equal to or greater than the width of the medium.

In the embodiment, the irradiation section 41 is provided with light emitting diodes (LED) as a light source of UV irradiation. It is possible for the LED to easily change the irradiation energy by controlling the size of the input current. In addition, a light source other than LED such as metal halide lamp may be used as the irradiation section 41. The light source of the irradiation section 41 is separated from the clear ink head 35 (and the color ink heads 31 to 34) due to being contained within the irradiation section 41. Due to this, UV which is irradiated from the light source is prevented from leaking to the lower surface of the clear ink head 35, and as such, the generation of the clogging of nozzles and the like, which is due to the UV ink being cured in the vicinity of the openings of each of the nozzles which are formed at the lower surface thereof, is suppressed.

Here, only one irradiation section 41 is provided at the farthest downstream side in the transport direction as the irradiation unit 40 in FIG. 4, but there may be a configuration where irradiation sections 41 are each provided at the downstream sides of each of the color ink heads. At this time, there is a configuration where an irradiation section 42 (not shown) is further provided at the most downstream side in the transport direction and the UV ink dots may be cured with a process with two stages by UV being irradiated from the irradiation section 41 and the irradiation section 42. For example, UV is irradiated from the irradiation section 41 with energy to the extent that the surface of the UV ink dots is cured (provisionally cured) and UV is irradiated from the irradiation section 42 at the final stage of the medium transportation with energy to the extent that the entirety of the UV ink dots is cured (completely cured). Due to this, the degree of curing of the UV ink dots is adjusted and it is possible that it is difficult for a problem to occur where the landing position of the dots is deviated due to impacting of the UV ink dots with a high degree of curing when the UV ink dots are discharged from each of the heads.

Detector Group

A rotary-type encoder (not shown), a medium detection sensor (not shown), and the like are included in the detector group 50. The rotary-type encoder detects the rotation amount of the transport roller 23A on an upstream side and the transport roller 23B on a downstream side. It is possible to detect the transport amount of the medium based on the detection result of the rotary-type encoder. The medium detection sensor detects the position of the front edge of the medium during feeding of the medium.

Controller

The controller 60 is a control unit (control section) for performing control of the printer. The controller 60 has an interface section 61, a CPU 62, a memory 63, and a unit control circuit 64.

The interface section 61 performs transmission and reception of data between the computer 110 which is an external device and the printer 1. The CPU 62 is a computation processing device for performing control of the entirety of the printer 1. The memory 63 is for securing a region which stores a program of the CPU 62, an operation region, and the like and is configured by a storage element such as RAM or EEPROM.

Then, the CPU 62 controls each of the units such as the transport unit 20 via the unit control circuit 64 in accompaniment with the program which is stored in the memory 63.

Image Printing Operation

An image printing operation using the printer 1 will be simply described.

When the printer 1 receives the printing data from the computer 110, first, the controller 60 rotates the medium feeding roller (not shown) using the transport unit 20 and the medium which is to be printed upon is sent on the belt 24. The medium is transported at a constant speed on the belt 24 without stopping and passes under each of the units of the head unit 30 and the irradiation unit 40.

During this, by the color ink (KCMY) being intermittently discharged from each of the nozzles of the color ink heads 31 to 34, text and images which are formed from color ink dots are formed on the medium. In addition, by the clear ink (CL) being intermittently discharged from each of the nozzles of the clear ink head 35, clear ink dots are formed on predetermined pixels. Then, UV is irradiated from the irradiation section 41 of the irradiation unit 40 and the color ink dots and the clear ink dots are cured. In this manner, an image is printed on the medium.

Finally, the controller 60 discharges the medium where the printing of the medium has been completed.

Relationship Between Ink Duty and Glossiness

Relationship Between Color Duty and Clear Duty

How the glossiness of an image changes due to the relationship between the discharge amount of the color ink which forms the image per unit region (referred to below as color duty) and the discharge amount of the clear ink which adjusts the glossiness per unit region (referred to below as clear duty) will be described.

Figure 6:
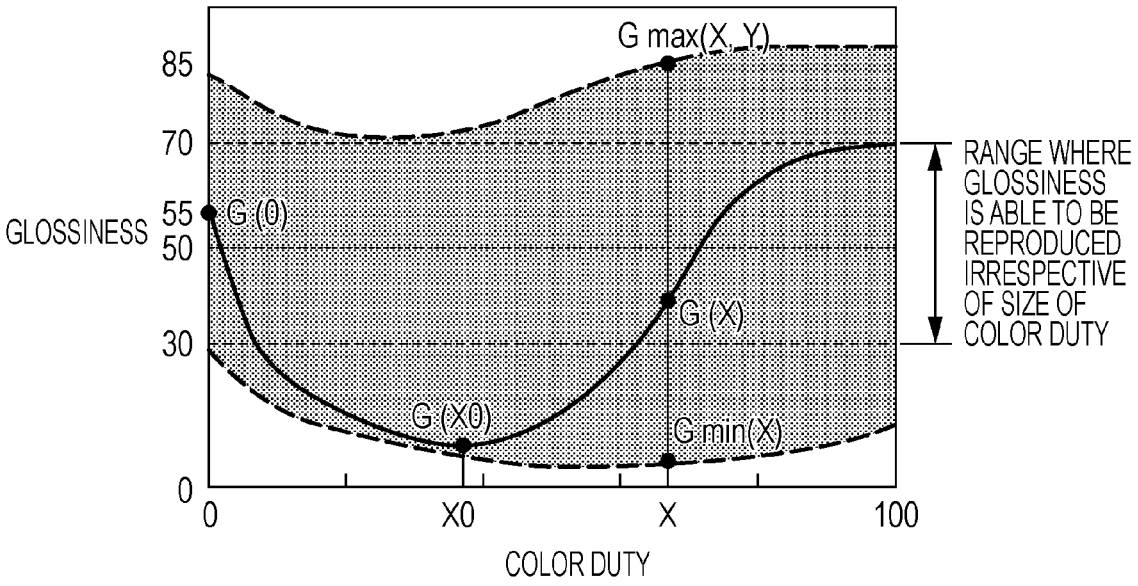
FIG. 6 is a diagram representing one example of a relationship of color duty and glossiness.

FIG. 6 is a diagram representing one example of a relationship of the color duty and glossiness. The horizontal axis in the diagram represents the discharge amount of the color ink per unit region (the color duty) and the vertical axis of the diagram represents the amount of the glossiness of an image which is formed due to the color ink (and the clear ink).

First, the line which is drawn with a thick solid line in FIG. 6 represents the glossiness of an image in a case where the image is printed while the discharge amount per unit region (color duty) using only the ink for forming the image (here, the color ink). In FIG. 6, when the size of the color duty is set as (X), the glossiness of the printed image is represented as G(X). In a case where printing is performed using only the color ink, the relationship of the color duty and the glossiness of the image is shown as the same relationship as that described in FIG. 2 described above. For example, when X=0% (the color duty is zero), the value of the glossiness of the medium itself is shown as G(0)=55. Then, along with an increase in the color duty (X), the glossiness G(X) gradually becomes smaller and the glossiness G(XO) is minimized when there is a predetermined color duty value X=XO %. After this, along with an increase in the color duty (X), the glossiness G(X) gradually becomes larger. In a case where only the color ink is used in this manner, at a certain portion in the image, the amount of glossiness G(X) at the portion is determined due to the color duty value (=X %). In other words, there is a difference in the glossiness for each portion where the gradation is different in the image which is formed since the glossiness is determined due to the color gradation value in a portion (pixel) which configures the image.

Therefore, the glossiness of the entire image is adjusted by further discharging a predetermined amount of the clear ink in addition to the color ink for each region (portion) in the image. Here, when the size of the clear duty is (Y) and the size of the color duty is (X), the glossiness of the printed image is represented as G(X,Y).

For example, the glossiness of the image when X=0 is G(0)=55, but it is possible to change the glossiness by discharging the clear ink. In FIG. 6, it is possible to change the glossiness of the image G(0,Y) within the range of 30 to 85 by changing the clear duty (Y) within the range of 0% to 100%. In the same manner, it is possible to change the glossiness of the image G(X,Y) within a predetermined range by changing the clear duty (Y) with regard to the color duty (X) which has a predetermined size.

In FIG. 6, the colorized region which is encompassed by the dashed line is the range of the amount of glossiness which is measured from the image which is formed by the color ink and the clear ink. The dashed line in the upper side of the diagram represents the upper value limit of the glossiness which is able to be reproduced Gmax(X,Y) by changing the color duty value (Y) with regard to a predetermined color duty value (X). In addition, the dashed line in the lower side of the diagram represents the lower value limit of the glossiness which is able to be reproduced Gmin(X,Y) by changing the clear duty value (Y) with regard to a predetermined color duty value (X). That is, it is possible to freely adjust the glossiness of the image in the region which is colorized in FIG. 6 by appropriately adjusting each of the values of the color duty (X) and the cleat duty (Y). Then, it is possible to form the image within a range where the glossiness is 30 to 70 by adjusting the size of the clear duty (Y) even if the size of the color duty (X) is any value.

Figure 7:
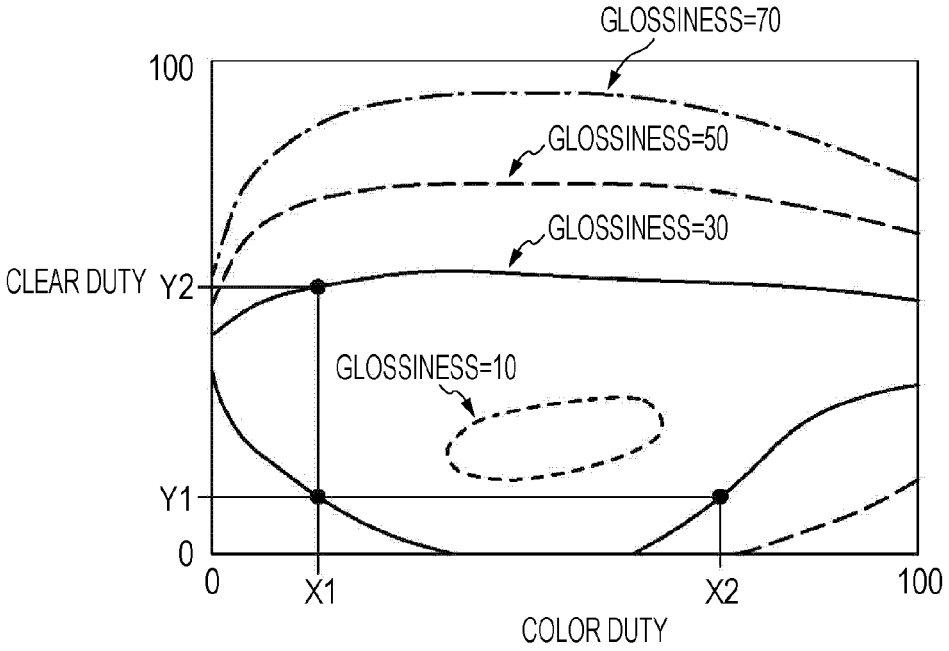
FIG. 7 is a diagram representing glossiness of an image in a case where color duty and clear duty are changed in FIG. 6.

FIG. 7 is a diagram representing the glossiness of the image in a case where the color duty and the clear duty are changed in FIG. 6. The vertical axis in the diagram represents the clear duty and the horizontal axis in the diagram represents the color duty. Then, the curve line which is drawn as a contour line in the diagram represents each amount of the glossiness. That is, FIG. 7 represents the relationship between the total amount of the amount of the color ink which is discharged per unit region and the amount of the clear ink which is discharged per unit region and the glossiness of the image which is formed using the color ink and the clear ink. For example, in a case where the color ink is discharged so that the color duty is (X1) when printing the image, it is sufficient if the clear ink is discharged so that the clear duty is (Y1) or (Y2) in order to print an image where the amount of the glossiness is 30. On the other hand, in a case where the clear duty is (Y1), the necessary color duty in order to print an image where the amount of the glossiness is 30 is (X1) or (X2).

If the relationship as in FIG. 7 is made clear, it is possible to print an image with a desired glossiness by appropriately selecting the size of the clear duty (Y) with regard to the color duty (X).

First Embodiment

In a first embodiment, the glossiness of the entire printed image is adjusted by the relationship which corresponds to FIG. 7 described above being determined in advance and the size of the clear duty being changed in accordance with the size of the color duty based on the relationship when the image is printed.

In the embodiment, two processes of a checking process and a printing process are carried out and the image is printed while the size of the clear duty with regard to the color duty is adjusted. Firstly, in the checking process, the relationship which corresponds to FIG. 7 is determined and stored in the printer 1. In other words, the relationship of the total amount of the color duty and the clear duty and the glossiness of the image is determined and held. Then, based on the relationship which is determined in the checking process, color image processing and clear image processing are performed so that there is the desired glossiness in the printing process and the image is printed while the discharge amount of the clear ink with regard to the color ink is being adjusted. Below, the details of each process will be described.

Checking Process

Figure 8:
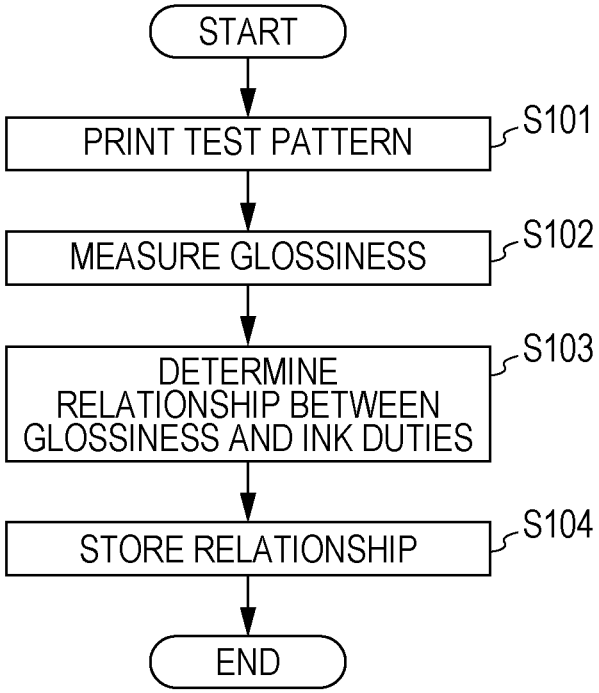
FIG. 8 is a diagram representing a flow of a checking process.

In the checking process, a text pattern with a plurality of types of patches, which are formed while the color duty and the clear duty are each being changed (that is, while changing the gradation value), is printed using the printer 1. Then, the glossiness is measured for each patch in the test pattern and a combination of the color duty and the clear duty when the glossiness becomes a predetermined size is examined. Due to this, the relationship of the color duty and the clear duty for forming an image which has a certain glossiness is determined and the relationship is held in a storage medium such as the memory 63. A diagram representing the flow of the checking process is shown in FIG. 8. The checking process is performed by executing the processing of S101 to S104.

Figure 9:
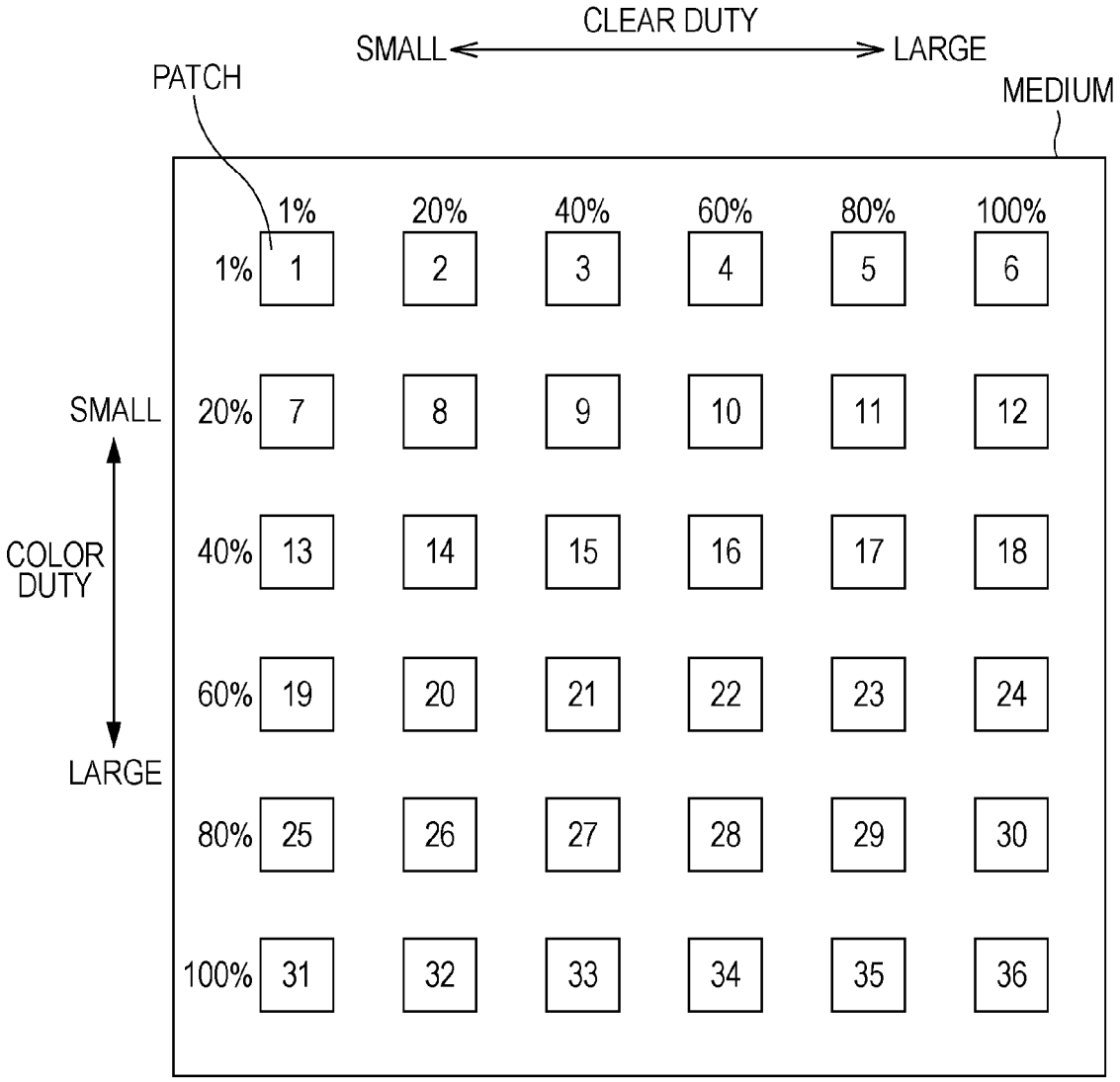
FIG. 9 is a diagram representing one example of a test pattern which is printed.

Firstly, the test pattern is printed (S101). The test pattern is formed by printing a plurality of patches using the color ink (KCMY) and the clear ink (CL). One example of the test pattern which is printed is shown in FIG. 9. The test pattern has a plurality of types of rectangular patches which are formed while the color duty and the clear duty being each changed by predetermined sizes. For example, in FIG. 9, the patches are formed by the color duty being divided into six stages of 1%, 20%, 40%, 60%, 80%, and 100%. In the same manner, the patches are formed by the clear duty being divided into six stages of 1%, 20%, 40%, 60%, 80%, and 100%. That is, the test pattern with 6×6=36 patches are printed. Here, a number attached to each patch is for convenience, it is not necessary to actually print such numbers, and the arrangement and shape of each of the patches is not limited to the example of FIG. 9. In addition, the number of patches is arbitrary and it is possible to more accurately obtain the relationship of the ink duty and the glossiness as more of the patches are formed by making the width of the changes in each of the ink duties small.

Here, since the glossiness of the printed image is affected by the glossiness of the medium itself, the test pattern is printed on the same medium as the medium which is actually used for printing. In a case where the printing is performed with regard to a plurality of types of mediums, the operations of the checking process (S101 to S104) are each performed with regard to each of the mediums which are used in printing.

In the embodiment, since the printing is performed using the four colors of KCMY color ink, it is calculated so that the color duty is 100% when the gradation value of all KCMY colors is 255 in the region (the pixels) where the color ink is discharged.

In addition, the test pattern is formed by the four colors of KCMY color ink and the clear ink being discharged at the same time, but test patterns may be formed for each color of KCMY. That is, the test pattern as shown in FIG. 9 may be formed by being divided into each of the KCMY color inks. In this case, in the printing process which will be described later, the clear ink discharge amounts are individually adjusted with regard to the discharge amounts of each of the KCMY color inks. For example, the clear ink (CL) duty is determined to correspond to the black ink (K) duty and the clear ink (CL) duty is separately determined to correspond to the cyan ink (C) duty for each predetermined region in the image.

After the test pattern has been printed, measurements for the glossiness in each of the patches is performed using a glossimeter described above (S102). Then, the relationship of the amount of the glossiness and the color duty and the clear duty is determined based on the measurement results of each of the patches (S103). That is, when the printing is performed on a certain medium using the printer 1, the size of the color duty and the clear duty for forming an image with a predetermined glossiness is examined. Due to this, the relationship between the total amount of the color duty and the clear duty and the glossiness of the image which is printed using the color ink and the clear ink which have been discharged is made clear. For example, in FIG. 9, the amount of the glossiness of the $5^{th}$ patch, the $10^{th}$ patch, and the $14^{th}$ patch is measured as 50. In this case, it means that the glossiness of the image, which has been printed with the clear duty as 80% when the color duty is 1%, is 50. In the same manner, the glossiness of the image, which has been printed with the clear duty as 60% when the color duty is 20% or with the clear duty as 20% when the color duty is 40%, is 50. For the measurement results, the combination of the color duty and the clear duty for forming an image where the glossiness is 50 is made clear. Then, from all of the data which is measured with regard to each of the patches in FIG. 9, a graph (a graph which corresponds to FIG. 7) which represents the relationship of the total amount of the color duty and the clear duty and the glossiness of the image is determined (S103). The relationship which has been determined is held in the memory 63 of the printer 1 (S104).

Due to the checking process, the relationship of the color duty and the clear duty for printing an image with a glossiness which is a target when printing the image on a certain medium is made clear.

Printing Process

The processing which is actually performed in the printer 1 when executing printing will be described.

In the printing process, the printing of the image (so that the irregularities in glossiness are reduced) is performed so that there is a predetermined glossiness using the printer 1 at the location of a user. The printed image is formed by discharging the color ink for each predetermined region. Then, the glossiness of the printed image is adjusted by discharging the clear ink in an amount which is determined based on the relationship which is determined in the checking process with regard to the discharge amount of the color ink per unit region (the color duty).

Figure 10:
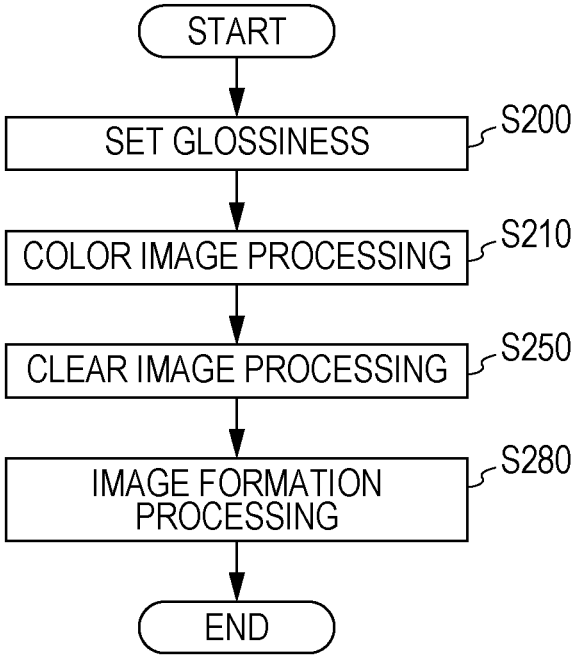
FIG. 10 is a diagram representing an overall flow of a printing process of a first embodiment.

The overall flow of the printing process of the embodiment is shown in FIG. 10. The printing process is formed from a glossiness setting process (S200), a color image processing process (S210) where processing is performed for printing an image by discharging the color ink, a clear image processing process (S250) which determines the clear ink discharge amount for each region according to the color ink discharge amount, and an image formation processing process (S280) which forms an image by actually discharging the color ink and the clear ink.

S200: Setting Glossiness

First, the glossiness of the image for which the user desires to print (target glossiness) is set (S200). For example, the items such as matte finish (glossiness: substantially 30), semi-gloss finish (glossiness: substantially 50), and glossy finish (glossiness: substantially 70) are displayed on a user interface (not shown) and are able to be selected. In addition, it may be set to be possible to input the glossiness as a numerical value.

Here, the setting of the glossiness (S200) may be performed after the color image processing (S210) which will be described later.

S210: Color Image Processing

Figure 11:
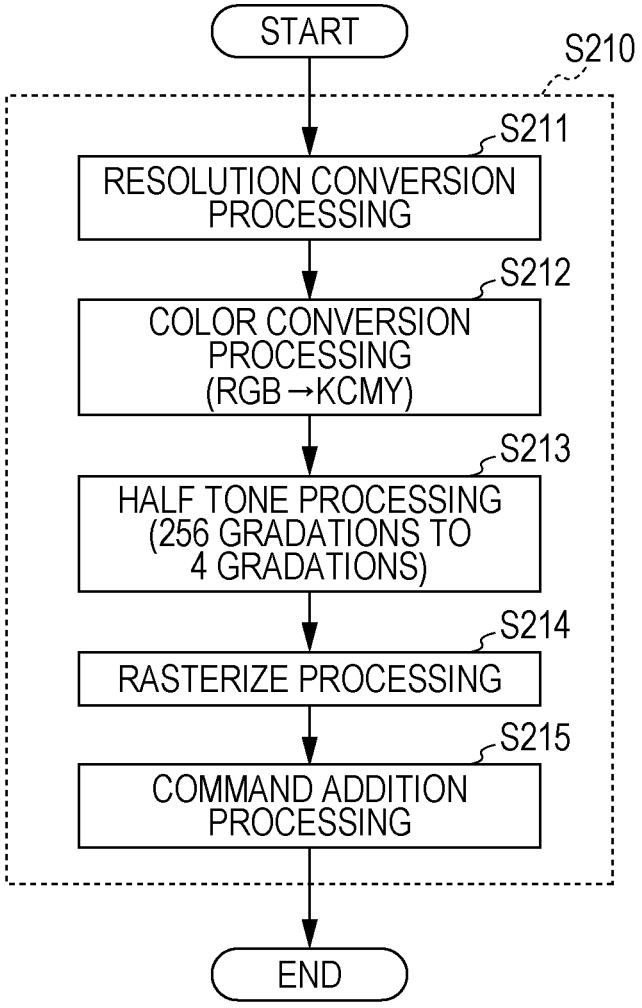
FIG. 11 shows a diagram representing a flow of processing which is performed using a printer driver in color image processing.

When the user of the printer 1 instructs printing of an image which is drawn on an application program, the printer driver of the computer 110 is activated. The printer driver receives image data from the application program, converts to printing data with a format which is able to be interpreted by the printer 1, and outputs the printing data to the printer 1. When the image data from the application program is converted to printing data, the printer driver performs resolution conversion processing, color conversion processing, half tone processing, and the like. A diagram which represents the flow of processing which is performed using the printer driver in the color image processing is shown in FIG. 11.

First, processing (resolution conversion processing) is performed when the image data which is output from the application program (text data, image data, and the like) is converted to a resolution (printing resolution) when printing onto the medium (S211). For example, in a case where the printing resolution is specified as 720×720 dpi, the image data with a vector format which is received from the application program is converted to image data with a bitmap format with a resolution of 720×720 dpi.

Here, each piece of pixel data in the image data after resolution conversion processing is RGB data with each gradation (for example, 256 gradations) which is represented by the RGB color space.

Next, color conversion processing where the RGB data is converted to data in the CMYK color space is performed (S212). The image data in the CMYK color space is data corresponding to the colors of ink which the printer has. The color conversion processing is performed based on a table (a color conversion lookup table LUT) where the gradation values of the RGB data and the gradation values of the CMYK data correspond.

Here, the image data after color conversion processing is eight-bit CMYK data with 256 gradations which is represented using the CMYK color space. Since the data is used even in the clear image processing (S250) which will be described later, the data is copied and temporarily held in the memory 63 or the like.

Next, half tone processing is performed where data with a high number of gradations is converted to data with a number of gradations which is able to be formed by the printer (S213). For example, due to the half tone processing, the data which indicates 256 gradations is converted to one-bit data which indicates two gradations or two-bit data which indicates four gradations. In the half tone processing, a dither method, a γ correction and error dispersion method, and the like is used. The data which has been half tone processed is the same resolution as the printing resolution (for example, 720×720 dpi). In the image data after the half tone processing, pixel data of one bit or two bits corresponds to each pixel and the pixel data is data which indicates the dot formation state for each pixel (presence or absent of a dot and the size of a dot).

After this, rasterize processing is performed where the pixel data which is lined up in a matrix formation is rearranged for each piece of pixel data in order of the data which is to be transferred to the printer 1 (S214). For example, the pixel data is rearranged according to the arrangement order of the nozzles in each of the nozzle rows.

A command addition processing is performed where command data is added to the data which has been rasterize processed according to the printing method (S215). As the command data, for example, there is transport data which indicates the transport speed of the medium and the like.

S250: Clearing Image Processing

Figure 12:
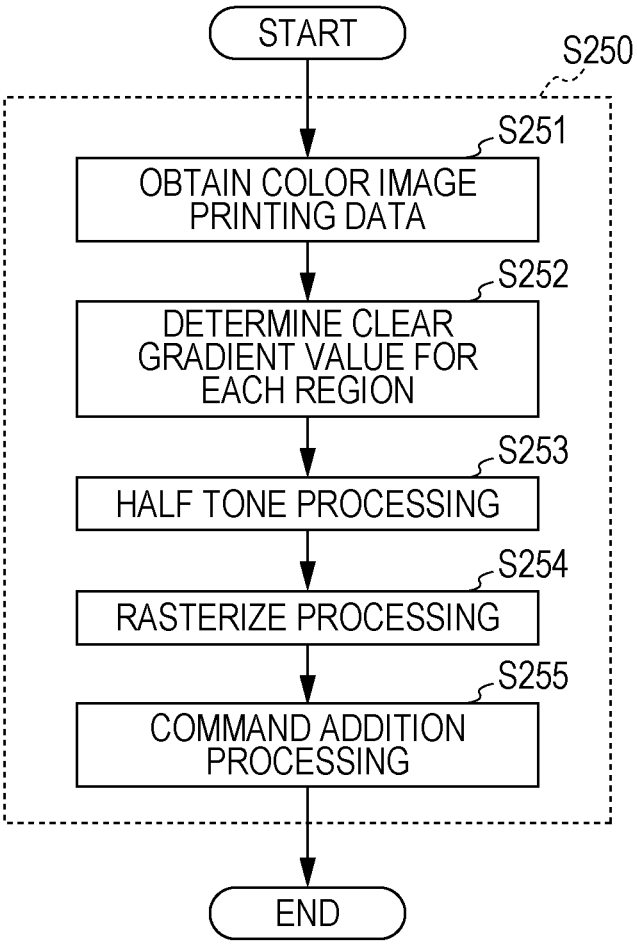
FIG. 12 shows a diagram representing a flow of processing which is performed using a printer driver in clear image processing.

Next, the clear image processing is performed for discharging the clear ink which adjusts the glossiness of the image. A diagram which represents a flow of the processing which is performed using the printer driver in the clear image processing is shown in FIG. 12.

First, the printer driver copies the color image printing data after the color conversion processing (S212) in the color image processing process and obtains the color image printing data as the data for clear image processing (S251). In the clear image processing, the data for discharging the clear ink is generated based on the data.

Next, the gradation value of the clear ink is set for each region (pixel) which forms an image using the color image data which has been obtained (S252). In other words, the amount of clear ink which is discharged to the region (clear duty) is determined by setting the clear gradation value for each predetermined region in the image. Here, for the description, the unit region is considered to be one pixel.

As described above, the image data after color conversion processing is eight-bit CMYK data which is shown using 256 gradations of 0 to 255 for each color in each pixel. The printer driver selects a certain pixel A in the image and calculates the color duty of the pixel A. The color duty is calculated from the total value of the gradation values of the four colors of KCMY. For example, in a case where the gradation value of K is 128, the gradation value of C is 64, the gradation value of M is 128, the gradation value of Y is 64 with regard to a pixel A, the color duty is calculated as (128+64+128+64)/(255+255+255+255)×100=37.6%.

Here, strictly speaking, the gradation value and the actual ink discharge amount are different amounts, but taking into account the points below, the gradation value and the ink duty are treated as corresponding to each other. That is, in the half tone processing described above, the gradation values with 256 gradations with regard to each color are converted to the gradation values with four gradations (or two gradations) and the ink is discharged based on the data with four gradations. At this time, if the gradation value before the half tone processing is large (for example, the gradation value is 255), it is easy for the gradation value after half tone processing to also be large (for example, the gradation value is 3) and there is a high probability that the ink discharge amount is large. On the other hand, if the gradation value before the half tone processing is small (for example, the gradation value is 1), it is easy for the gradation value after half tone processing to also be small (for example, the gradation value is zero) and there is a high probability that the ink discharge amount is small. Accordingly, it is possible to consider that the amount of the color ink which is discharged per unit region (the color duty) corresponds to the size of the gradation values with 256 gradations.

As described above, in a case where the relationship with the clear duty for each color of KCMY in the checking process (the relationship which corresponds to FIG. 7) has been determined, the color duty is calculated for each color of KCMY.

Then, the relationship between the color duty and the clear duty which is held in the memory 63 in the checking process is read out and the clear duty in the pixel A is determined so that there is the glossiness which is set in the glossiness setting process (S200). Due to this, the clear gradation value in the pixel A (discharge amount) is determined. Here, the clear gradation value is 255 when the clear duty is 100%.

Figure 13:
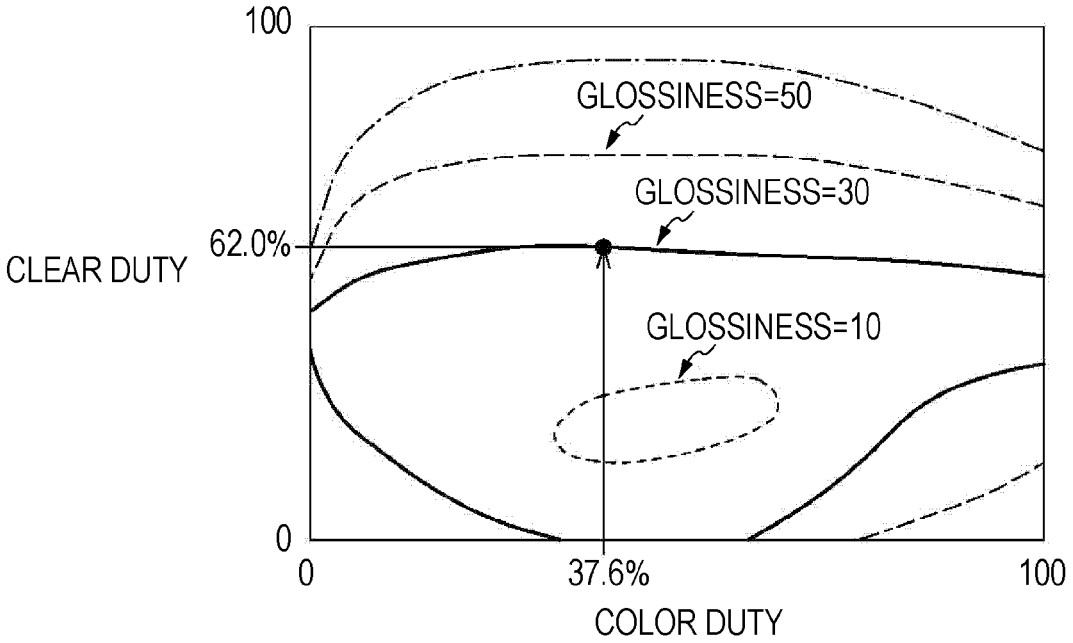
FIG. 13 is a diagram describing a method where clear duty is determined with regard to color duty.

FIG. 13 is a diagram specifically describing a method where the clear duty is determined with regard to the color duty. Here, the relationship in FIG. 13 corresponds to that which is described in FIG. 7.

In the checking process, the relationship between each of the ink duties and the glossiness as shown in FIG. 13 is determined, and for example, the target glossiness is set as 30 and the color duty is calculated as 37.6% in the certain pixel A. In this case, a clear duty of 62.0%, which corresponds to the color duty 37.6% in the curve (contour line) with glossiness at 30 in FIG. 13, is determined as the clear duty with regard to the pixel A. In addition, in a case where the glossiness is set as 40 or the like, there is interpolation of the clear duty which is determined from the curve of the glossiness at 30 and the glossiness at 50 with regard to the color duty of 37.6% and the clear duty value which is used when printing is calculated.

In the description described above, the clear duty is determined for each pixel, but the clear duty is determined for each region which is formed of a plurality of pixels when actually printing. For example, the color duty in the region is calculated from the average of the color gradation values in a region of 10×10 pixels and the clear duty is determined to correspond to the color duty which has been calculated. Then, according to the clear duty which has been determined, the clear ink is discharged to the region (the region of 10×10 pixels). Due to this, it is possible to speed up the processing speed of the clear image processing compared to performing of the processing for each of the individual pixels.

After that, in the same manner as the case of the color image processing, the half tone processing (S253), the rasterize processing (S254), and the command addition processing (S255). The clear image processing is complete.

S280: Image Formation Processing

According to the printing data of the color image and the clear image which are generated in each of the processing described above, the discharging of each of the color inks is actually performed. That is, the color image is formed by discharging the color ink onto the medium according to the color image printing data. Then, it is possible to print an image where the irregularities of glossiness are small by discharging a predetermined amount of the clear ink for each unit region so as to overlap on the color image according to the clear duty which has been set.

Conclusion of First Embodiment

In the first embodiment, the relationship between the total amount of the color ink duty and the clear ink duty and the glossiness of the image which is formed using the color ink and the clear ink is determined. Then, the clear duty which corresponds to the color duty is determined so that an image with the desired glossiness is formed based on the relationship which has been determined and each ink (the color ink and the clear ink) is discharged.

Due to this, it is possible to form an image with excellent image quality where the irregularities in glossiness are small over the entire printed image when the printing is performed using the UV ink.

Second Embodiment

In a second embodiment, the discharge amount of the clear ink per unit region (the clear duty) is determined taking further other factors into consideration while adjusting the irregularities in glossiness in the image. Specifically, the clear duty with regard to the color duty is determined in the printing process by taking into consideration, the image quality of the image and the amount of discharge ink as well as the glossiness of the printed image.

Here, the action of determining the relationship between the color duty and the clear duty and the glossiness in the checking process is the same as the first embodiment and description will be performed having obtained the relationship which corresponds to FIG. 7 described above in the embodiment. In addition, the configuration of the printing apparatus itself is the same as the printer 1 which is described in the first embodiment. Below, the description will be centered on the points which are different from the first embodiment.

Printing Process of Second Embodiment

Figure 14:
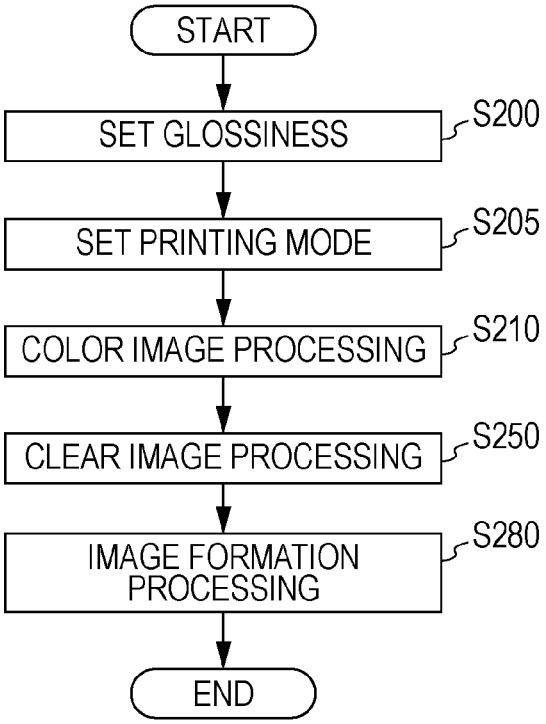
FIG. 14 is a diagram representing an overall flow of a printing process of a second embodiment.

An overall flow of the printing process in the second embodiment is shown in FIG. 14. In the embodiment, there is a process (S205) where the printing mode is set after the glossiness setting process (S200).

The printing mode is able to select, for example, an image quality priority mode which prioritizes improves in image quality of the printed image (set as a first mode) and an ink economizing mode where the amount of ink which is discharged is reduced as much as possible (set as a second mode) and each mode is selected by the user. The selection of the mode is performed via a user interface which is not shown. Here, the order of the glossiness setting (S200) and the printing mode setting (S205) may be interchanged and executed.

Next, the color image processing (S210), the clear image processing (S250), and the image formation processing (S280) are performed. The color image processing in the second embodiment is the same as the first embodiment (refer to FIG. 11). On the other hand, in the clear image processing where the data for discharging the predetermined amount of clear ink to a predetermined region is generated (refer to FIG. 12), the method of determining the clear duty (S252) is different to the first embodiment. After the clear duty is determined for each region in S252, the same processing as the first embodiment (S253 to S255) is performed, and at the end, the color ink and the clear ink are discharged and the image is formed.

Determining of Clear Duty

In the determining of the clear duty in the second embodiment (S252), the optimal clear duty value is determined according to the mode which is set in S205. That is, there are cases where the clear duty values which are different due to the mode which has been selected are determined.

Figure 15:
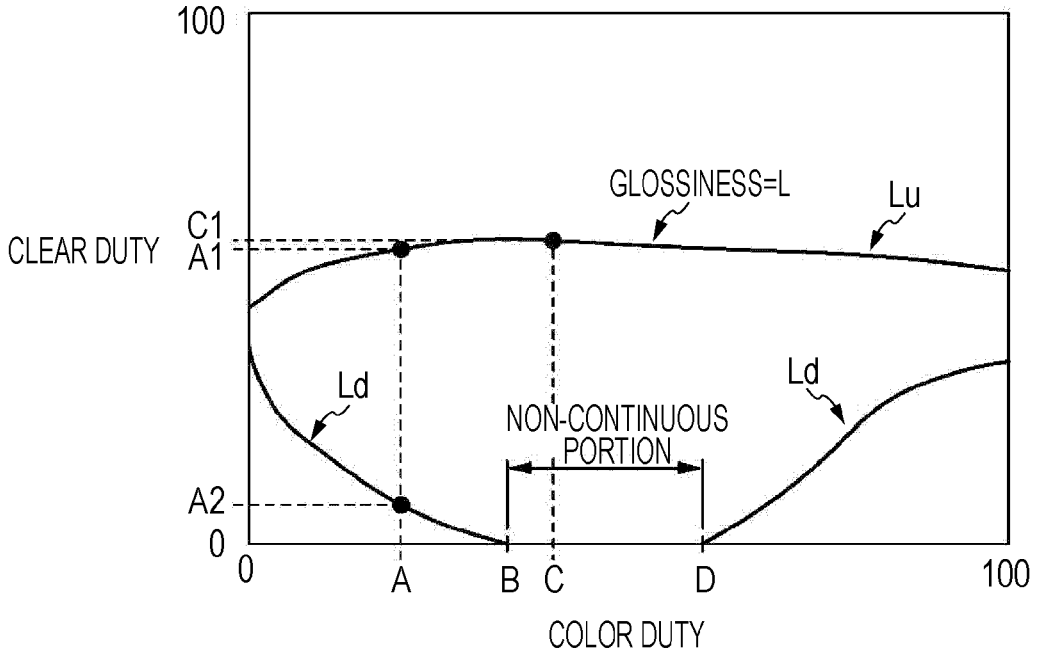
FIG. 15 is a diagram describing a method where clear duty is determined using a second embodiment.

A diagram which describes the points which are to be considered when determining the clear duty is shown in FIG. 15. The vertical axis in the diagram represents the size of the clear duty and the horizontal axis represents the size of the color duty (the units are both percentages). The curve in the diagram represents the relationship of the color duty and the clear duty when the image where the glossiness is L is printed. The curve has two curves of a curve Lu in the upper side of the diagram and a curve Ld in the lower side. The curve Lu in the upper side is continuously drawn without any breaks from where the value of the color duty is 0% to 100%. That is, there is a relationship (a first relationship) where there is a color duty value which corresponds to the color duty value in the entire range where the color duty value changes (0% to 100%).

On the other hand, the curve Ld in the lower side is broken in the sector where the color duty value is B % to D % and there is an non-continuous portion. That is, in the predetermined range (B % to D %) where the color duty changes, there is a relationship (a second relationship) where there is no clear duty value which corresponds to the color duty value.

In FIG. 15, when the color duty is A %, two types of A1% (a point on the curve Lu) or A2% (a point on the curve Ld) of the clear duty, which corresponds to the color duty (A %) for printing the image with the glossiness of L, are possible. In other words, there is a plurality of clear duties which correspond to the color duty. On the other hand, there is only C1% (a point on the curve Lu) of the clear duty which corresponds when the color duty is C % which belongs to the non-continuous portion of the curve Ld described above in order to form the image with the glossiness of L. In other words, there is only one clear duty which corresponds to the color duty.

That is, there are cases where only one clear duty which is used when printing with regard to a certain duty value is determined when printing an image with a predetermined glossiness and cases where selection of a plurality is possible. Then, even in a case where the image with the same glossiness is printed, the image quality of the printed image and the amount of discharge ink significantly changes due to differences in the clear duty value.

For example, when the color duty in two certain regions in the printed diagram are each A % and C %, the clear duty is determined based on the first relationship described above (the curve Lu in FIG. 15). That is, the clear duty which corresponds to the color duty of A % is A1% and the clear duty which corresponds to the color duty of C % is C1%. In this case, the variation width in the clear duty in both regions is along the curve Lu and is a comparatively little variation (C1−A1).

Next, when the clear duty is determined based on the second relationship described above (the curve Ld in FIG. 15), the clear duty which corresponds to when the color duty is A % is A2%. On the other hand, since there is no clear duty which corresponds to when the color duty is C % on the curve Ld, the curve Lu is necessarily referenced referred to and the clear duty of C1% is set. In this case, the variation width in the clear duty in both regions is large (C1−A2).

When the clear duty values in each of the regions in the image are significantly different in this manner, there is a difference in image quality in each location.

Case where Improvement in Image Quality is Prioritized

First, a case where the image quality of the printed image is improved while the generation of the irregularities in glossiness are suppressed (a case where the first mode is selected) will be described.

When the variation width of the clear duty between two regions becomes large as described above, a difference appears in the image quality of the image which is printed. Here, image quality refers to the granularity and texture of the surface of the printed image. Granularity represents the extent of the surface roughness of the entire image, and for example, individual granules stand out when the ink dots (granules) which are formed on the medium are too large and an impression is given where the image has a rough surface. Accordingly, when the variation width of the clear duty in two region is large, the different in the size of the clear ink dots between the regions stands out and there are cases where the granularity is seen as different. In addition, the texture of the image is the feeling received due to differences in the properties of the ink material. For example, since the properties are different due to the presence or absence of pigments or colorants (colorizing agents) or the like in the clear ink and the color ink, the portion where the color duty and the clear duty are excessively difference in the surface of the printed image is seen with a different texture. Accordingly, when the variation width of the clear duty in the two regions stands out, the difference in texture stands out from the amount of clear ink dots which is formed in both region being different and image quality deteriorates.

Therefore, improvement in the image quality of the printed image is achieved by determining the clear duty which corresponds to the color duty so that it is difficult for irregularities to occur in the granularity and the texture while suppressing irregularities in the image in the first mode.

Specifically, the clear duty which is used when actually printing is determined based on the first relationship where it is possible to set the clear duty which corresponds to the color duty in the entire range. For example, in a case where the image is printed with the target glossiness as L in FIG. 15, the clear duty value of C1% is selected in the region where the color duty is C % (set as a region Q) and the clear duty values of A1% is selected in the region where the color duty is A % (set as a region P).

In a case where A2% is provisionally selected as the clear duty value in the region P, the variation in the clear duty with the region Q is large and it is easy for deterioration in image quality in the image to stand out. However, by selecting the clear duty value of A1% in the P region, the variation in the clear duty between both of the regions is suppressed to be as small as possible and it is possible to realize printing with high image quality while suppressing the irregularities in glossiness (uniformity in the glossiness L).

According to this method, it is easy for the discharge amount of the clear ink to be large and there is a possibility that printing costs will increase. However, since the improvement in image quality is prioritized in the first mode, there is setting so that the variation in the clear duty is reduced irrespective of the size of the clear ink discharge amount.

Case where Amount of Ink is Economized

Next, a case where there is a desire to reduce the discharge amount of the clear ink while arranging the glossiness of the overall image (a case where a second mode is selected) will be described.

As shown in FIG. 15, in a case where there is a possibility that a plurality of clear duties are able to be set (two in FIG. 15) in order to realize the target glossiness with regard to a certain color duty value, the clear duty is set so that the discharge amount of the clear ink is reduced in the second mode. That is, the value out of the plurality of clear duties which is the smallest is determined as the clear duty which is actually used when printing. For example, in a case where the image is printed with the target glossiness is L in FIG. 15, the clear duty is not set as A1% but A2% (A1>A2) when the color duty is A % in the certain region in the image.

According to this method, the variation in the clear duty is large and there is a concern that the image quality of the printed image may deteriorate. However, it is possible to cut the printing costs since it is possible to reduce the amount of clear ink which is discharged in the second mode.

Conclusion of Second Embodiment

In the second embodiment, printing is performed by selecting the first mode, where the clear ink is discharged so that there is excellent image quality while the image where the irregularities in glossiness are small is formed, or the second mode where the amount of clear ink which is discharged is economized while the image where the irregularities in glossiness are small is formed.

Due to this, it is possible to print an image which is more desired by the user according to the printing purpose.

Modification Example of Second Embodiment

The first mode and the second mode have been described in the example described above, but it may be set so that other modes are able to be selected. In the first mode, while it is possible to improve the image quality of the printed image, the ink discharge amount increases. In addition, in the second mode, while it is possible to economize on the ink discharge amount, there is a concern that the image quality of the printed image deteriorates. Therefore, as the modification example of the second embodiment, a mode (third mode) will be described where the image quality is improved, and further, the clear ink discharge amount is economized while irregularities in glossiness are made to stand out as little as possible.

Figure 16:
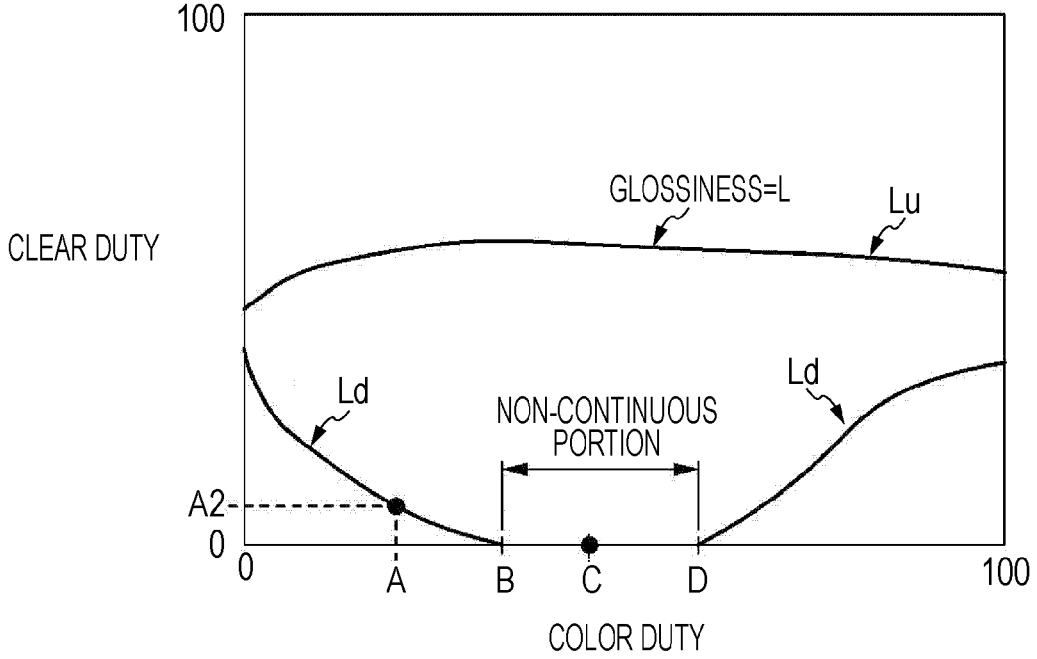
FIG. 16 is a diagram describing a method where clear duty is determined using a modification example of the second embodiment.

A diagram which describes a clear duty determination method which is the modification example of the second embodiment is shown in FIG. 16. FIG. 16 is a diagram which is basically the same as FIG. 15 and the curve Lu on the upper side represents the first relationship described above and the curve Ld on the lower side represents the second relationship. Accordingly, the clear duty value, which corresponds to the color duty value with the same size, is lower in the second relationship (the curve Ld) than the first relationship (the curve Lu).

In a case where there is a desire to print an image with the target glossiness as L, the clear duty value which is used when printing is determined in the third mode based on the second relationship (the curve Ld) where the clear duty is basically lower in order to economize on the clear ink which is discharged. For example, when the color duty is A % in FIG. 16, the clear duty is determined as A2% from the curve Ld. However, in a case where there is an attempt to determine the clear duty based on the second relationship, the clear duty value which is used in printing is not able to be determined since there is no clear duty which corresponds to the color duty within the range of B % to D %. Therefore, the CPU 62 sets the clear duty value to zero in the range of the color duty (B % to D %).

That is, in the non-continuous portion of the curve Ld (the range of B % to D % of the color duty), the clear duty value of the curve Ld is seen as being zero.

This has the meaning that the clear duty value which is not on the curve (the curve Ld) of the glossiness L and it is not possible to form an image with the glossiness of L in the region. That is, the glossiness is different between the region P where the color duty is A % and the region Q where the color duty is C % and this is considered to be a cause of the irregularities in glossiness. However, if the difference in the glossiness is equal to or less than a predetermined size (for example, 20), it is difficult to see that the image quality has deteriorated since the irregularities in glossiness are hardly able to be recognized when the image is visually confirmed with the naked eye of a person. That is, in the third mode, it is possible to print an image so that the deterioration in image quality does not stand out while the clear ink discharge amount is economized by permitting irregularities in glossiness in a range where the difference in glossiness does not stand out for each region in the image.

Other Embodiments

The printer and the like have been described as one embodiment, but the embodiment described above is so that it is easy to understand the invention and it is not to be interpreted as limiting the invention. It is needless to say that modifications and alterations are possible which is not depart from the gist of the invention and equivalents are included in the invention. In particular, even the embodiments which are described below are included in the invention.

Printing Apparatus

In each of the embodiments described above, the printer has been described as one example of the printing apparatus, but the invention is not limited to this. For example, technology in the same manner as the embodiment may be applied to various types of printing apparatuses where ink jet technology is applied such as color filter manufacturing devices, dyeing devices, precision processing devices, semiconductor manufacturing devices, surface processing devices, three-dimensional molding devices, liquid vaporization devices, organic EL manufacturing devices, (in particular, polymer EL manufacturing devices), display manufacturing devices, film-forming devices, and DNA chip manufacturing devices.

Ink Jet Printer

In the embodiment described above, there is description where an example is given of a line head type printer where the head is fixed as the ink jet printer, but the printer may be a so-called serial printer where the head moves along with the carriage.

Nozzle Row

In the embodiment described above, an example has been described where an image is formed using the four colors of KCMY and clear ink, but the invention is not limited to this. For example, the recording of the image may be performed using ink with color other than KCMY and CL such as light cyan, light magenta, and white.

In addition, the arrangement order of the nozzle rows in the head section is arbitrary. For example, the order of the nozzle rows of K and C may be swapped and there may be a configuration where the number of nozzle rows with K ink is larger than the number of nozzle rows with the other ink.

Piezo Element

In each embodiment described above, a piezo element PZT is illustrated as the element which performs the action for discharging the liquid, but it may be another element. For example, a heater element or an electrostatic actuator may be used.

The entire disclosure of Japanese Patent Application No. 2011-130359, filed Jun. 10, 2011 is expressly incorporated by reference herein.

What is claimed is:

1. A printing apparatus comprising:

a head section which discharges a color ink which is curable by irradiation of light and a clear ink which is curable by irradiation of light;

an irradiation section which irradiates the light;

a setting section which sets a target glossiness to be used as target; and a storage section which stores a relationship between a total amount of color duty which is related to an amount of the color ink which is discharged per unit region and clear duty which is related to an amount of the clear ink which is discharged per unit region, and glossiness of an image which is printed using the color ink and the clear ink which have been discharged, wherein the head section changes an amount of the clear ink which is discharged onto a medium according to the target glossiness, the relationship between the color duty and clear duty, and the color duty of the image.

2. The printing apparatus according to claim 1, wherein the setting section sets a value of the target glossiness to be lower than a value of glossiness of the medium.

3. The printing apparatus according to claim 1, wherein the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and a value based on the first relationship out of a plurality of clear duties is determined as the clear duty which is used when printing in a case where there is a plurality of the clear duties which correspond to a certain size of the color duty based on the first relationship and the second relationship.

4. The printing apparatus according to claim 1, wherein the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and a value which is the smallest out of a plurality of clear duties is determined as the clear duty which is used when printing in a case where there is a plurality of the clear duties which correspond to a certain size of the color duty based on the first relationship and the second relationship.

5. The printing apparatus according to claim 1, wherein the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and the clear duty which is used when printing is set to zero in a range where there is no clear duty which corresponds to the color duty in a case where the clear duty which is used when printing is determined based on the second relationship.

6. The printing apparatus according to claim 1, wherein, with regard to a test pattern with a plurality of types of patches which are formed while changing each of the color duty and the clear duty using the printing apparatus, the relationship is determined by examining the combination of the color duty and the clear duty when the glossiness value is a predetermined amount based on the glossiness which is measured for each of the plurality of types of patches.

7. A printing method comprising:

setting a target glossiness to be used as target;

discharging a color ink which is cured due to irradiation of light and a clear ink which is cured due to the irradiation of light;

irradiating the light; and storing a relationship between a total amount of color duty which is related to an amount of the color ink which is discharged per unit region and clear duty which is related to an amount of the clear ink which is discharged per unit region, and glossiness of an image which is printed using the color ink and the clear ink which have been discharged, wherein the amount of the clear ink which is discharged onto a medium is changed according to the target glossiness, the relationship between the color duty and clear duty, and the color duty of the image.

8. The printing method according to claim 7, wherein the value of the target glossiness is set to be lower than a value of glossiness of the medium.

9. The printing method according to claim 7, wherein the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and a value based on the first relationship out of a plurality of clear duties is determined as the clear duty which is used when printing in a case where there is a plurality of the clear duties which correspond to a certain size of the color duty based on the first relationship and the second relationship.

10. The printing method according to claim 7, wherein the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and a value which is the smallest out of a plurality of clear duties is determined as the clear duty which is used when printing in a case where there is a plurality of the clear duties which correspond to a certain size of the color duty based on the first relationship and the second relationship.

11. The printing method according to claim 7, wherein the relationship has a first relationship, where there is the clear duty which corresponds to an entire range where the color duty varies, and a second relationship, where there is no clear duty which corresponds to a predetermined range where the color duty varies, when an image is printed with a predetermined glossiness, and the clear duty which is used when printing is set to zero in a range where there is no clear duty which corresponds to the color duty in a case where the clear duty which is used when printing is determined based on the second relationship.

12. The printing method according to claim 7, wherein, with regard to a test pattern with a plurality of types of patches which are formed while changing each of the color duty and the clear duty using the printing apparatus, the relationship is determined by examining the combination of the color duty and the clear duty when the glossiness value is a predetermined amount based on the glossiness which is measured for each of the plurality of types of patches.

* * * * *